US006224520B1

(12) United States Patent
Hsu

(10) Patent No.: US 6,224,520 B1
(45) Date of Patent: May 1, 2001

(54) DUMBBELL

(76) Inventor: Wen-Chung Hsu, P.O. Box 90, Tainan City (TW)

( * ) Notice: Subject to any disclaimer, the term of this patent is extended or adjusted under 35 U.S.C. 154(b) by 0 days.

(21) Appl. No.: 09/572,909

(22) Filed: May 17, 2000

(51) Int. Cl.[7] ..... A63B 21/075
(52) U.S. Cl. ..... 482/107; 482/108
(58) Field of Search ..... 482/50, 93, 106–109

(56) References Cited

U.S. PATENT DOCUMENTS 6,010,436 * 1/2000 Obery et al. ..... 482/107

* cited by examiner

*Primary Examiner*—John Mulcahy

(57) ABSTRACT

A dumbbell includes a bar, a soft cushion wrapping around the bar, two end caps, and two weights as main components. The two end caps respectively are combined with and close on two ends of the bar. Between each end cap and a vertical circular disc is formed a support space for each weight to fit around thereon. Each weight has an elastic annular cloth bag wrapping iron sand, having flexibility to change its shape a bit by force to fit tightly around the support space. A user can replace the weights with other ones of different weight volume. If the dumbbell should fall down on the ground, it might not produce sound because of flexibility of the weights, not hurting a user or a person around, the ground surface or the weights, and thus very safe to use.

1 Claim, 4 Drawing Sheets

DUMBBELL

BACKGROUND OF THE INVENTION

This invention relates to a dumbbell, particularly to one having a bar, a weight respectively fixed with two ends of the bar and containing iron sand wrapped in an elastic cloth bag and changeable to a different weight according to a user's need. In addition, the weight is flexible in its shape, so when the dumbbell falls down on the ground by accident, it cannot produce large sound, or hurt the feet of the user owing to its flexibility, and thus is very safe to use.

A known conventional dumbbell shown in FIG. 1 includes a bar 10, a contact edge 11 formed at two ends of the bar, a support end 12 respectively formed to extend outward from the stop edge 11, a weight 13 of different weights fitted on the support end 12. The support end 12 has an inner threaded hole 120 and a stop means 14 screwed with the outer end of the support end 12. The stop means 14 has a threaded rod 140 extending outward to screw with the inner threaded hole 120 of the support end 12, with the stop means and the stop edge 11 limiting the weight 13 on the support end 12 in a stabilized condition. When the weight 13 is to be changed to another one, only loosen the stop means 14 and take off the old weight the support end 12, and then put a new weight 13 on the support end 12 and screw tightly the stop means 14.

However, the weights of the conventional dumbbell are generally a hard solid one, to a user may often let it fall down carelessly, producing an extremely large sound with the weights broken. So a user has to use it very carefully, lest he should let it fall down to hurt a person around. Moreover, if the stop means 14 should loosen and fall down for an unknown reason, an accident may happen.

SUMMARY OF THE INVENTION

The objective of the invention is to offer a dumbbell simple in changing the weights, and very safe to use, and producing quite little sound even if it should fall down.

The main feature of the invention is two weights respectively made of an elastic annular cloth bag containing iron sand, and a bar provided with a soft cushion, and a vertical stop disc respectively formed in two ends of the bar, and an annular projection respectively formed to extend outward from each vertical stop disc and provided with an annular groove on its outer annular surface. Further, an end cap is provided to fit with the annular projection of the two ends of the bar, having an outer convex side and a tubular projection extending inward from the outer side and provided with an annular projection on an inner annular surface to engage with the annular groove of the two ends of the bar. Then a support space is formed between the end cap and the vertical stop disc for each weight to fit around it. Then even if the dumbbell should fall down, the two weights may not produce sound or break, as they may change the shape as flat as possible owing to the elastic annular cloth bags with iron sand wrapped therein when they strike the ground surface.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
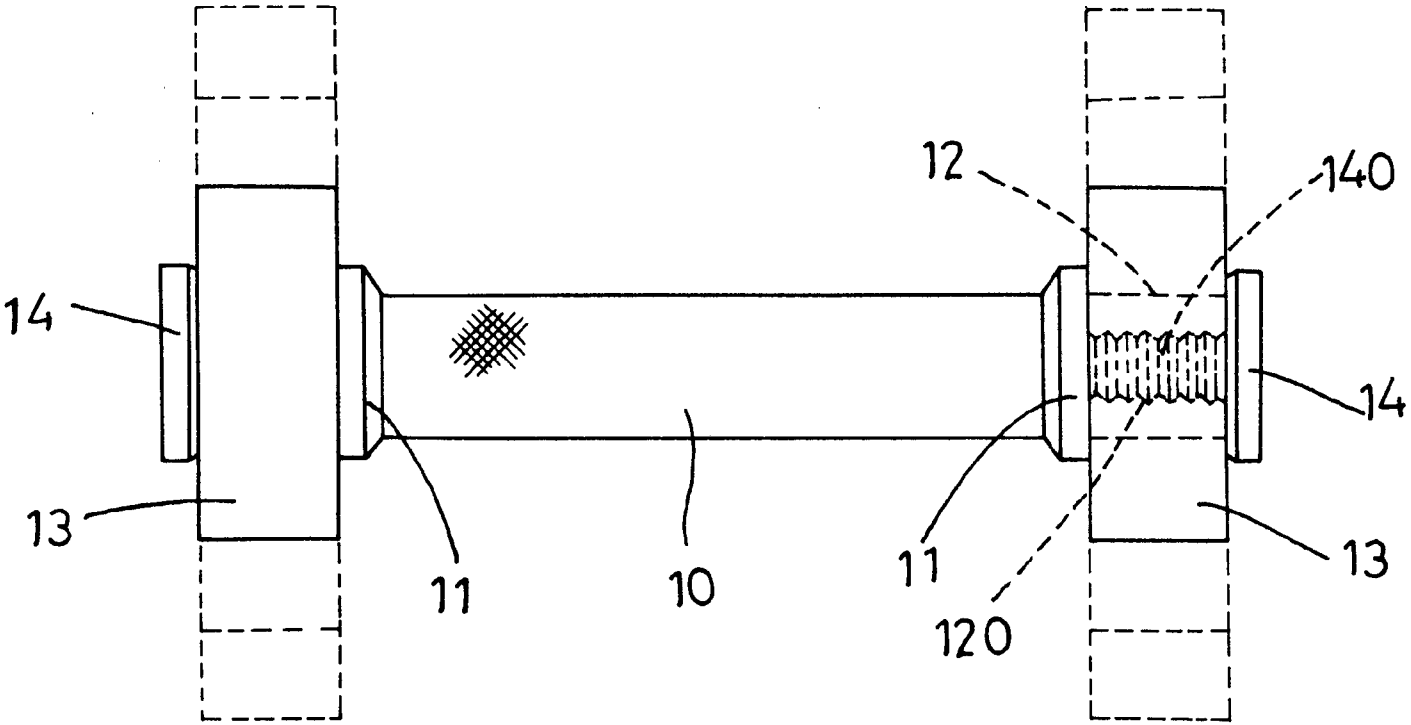
FIG. 1 (PRIOR ART)
FIG. 1 is a side cross-sectional view of a known conventional dumbbell.

A preferred embodiment of a dumbbell in the present invention, as shown in FIG. 1, includes a bar 2, a soft cushion 3, two end caps 4, and two weights 5 as main components combined together.

The bar 2 has two ends respectively provided with a vertical stop disc 20, a circular projection 21 formed to extend outward from the stop disc 20 and having an annular insert groove 22 formed on an annular outer surface.

The soft cushion 3 wraps around an outer surface of the bar 2.

The two end caps 4 are respectively combined with the circular projection 21, having a tubular projection 40 formed to extend outward and provided with a center hole 41 and an annular projection 42 formed by an inner wall defining the center hole 41. Then the annular insert groove 22 of the circular projection 21 of the grip 2 engages the annular projection 42.

The two weights 5 are fitted respectively between the stop disc 20 and the end caps 4, having an elastic annular cloth bag 50 wrapping iron sand 51 with some flexibility.

Figure 2:
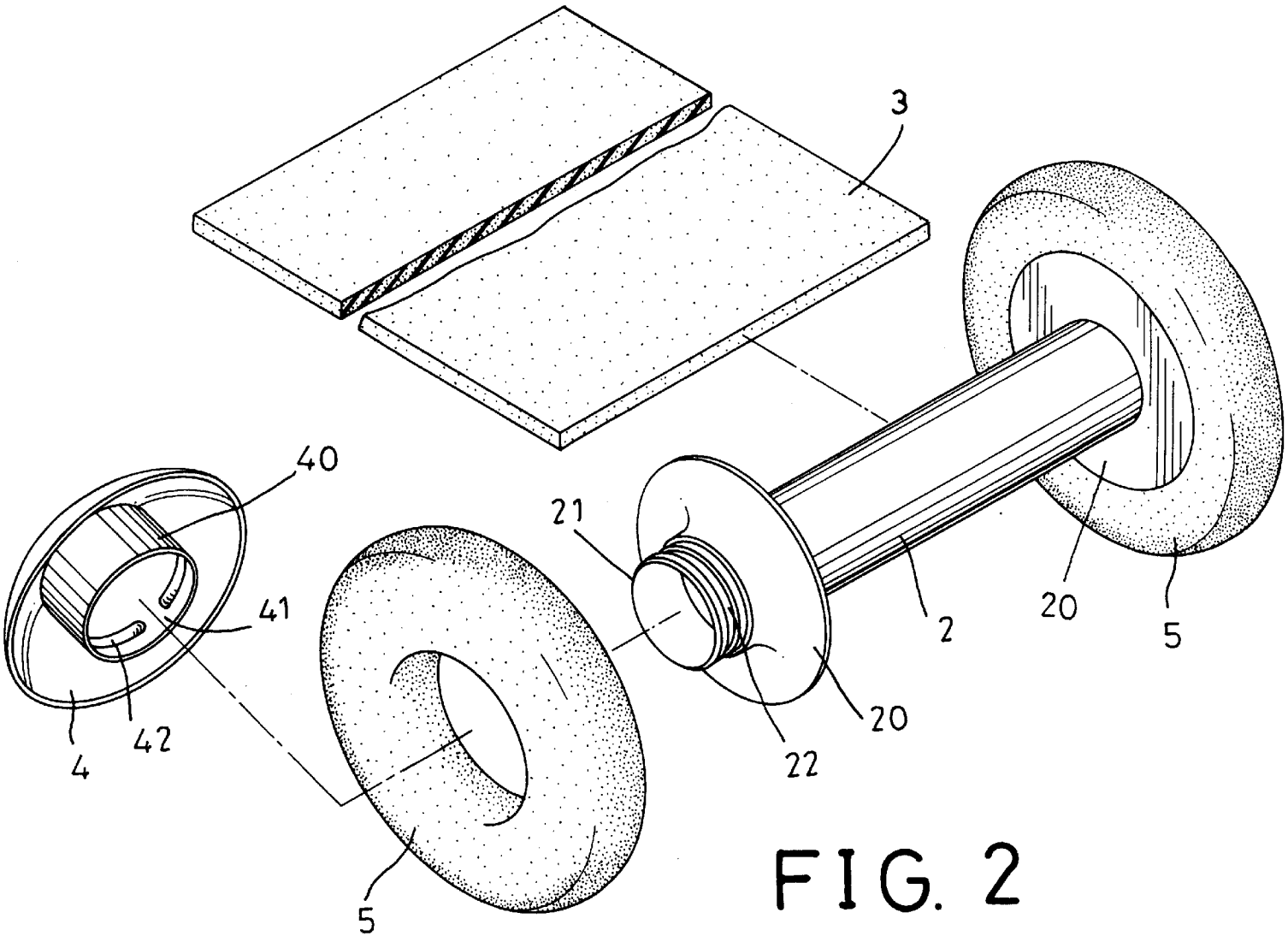
FIG. 2 is an exploded perspective view of a dumbbell in the present invention.
Figure 3:
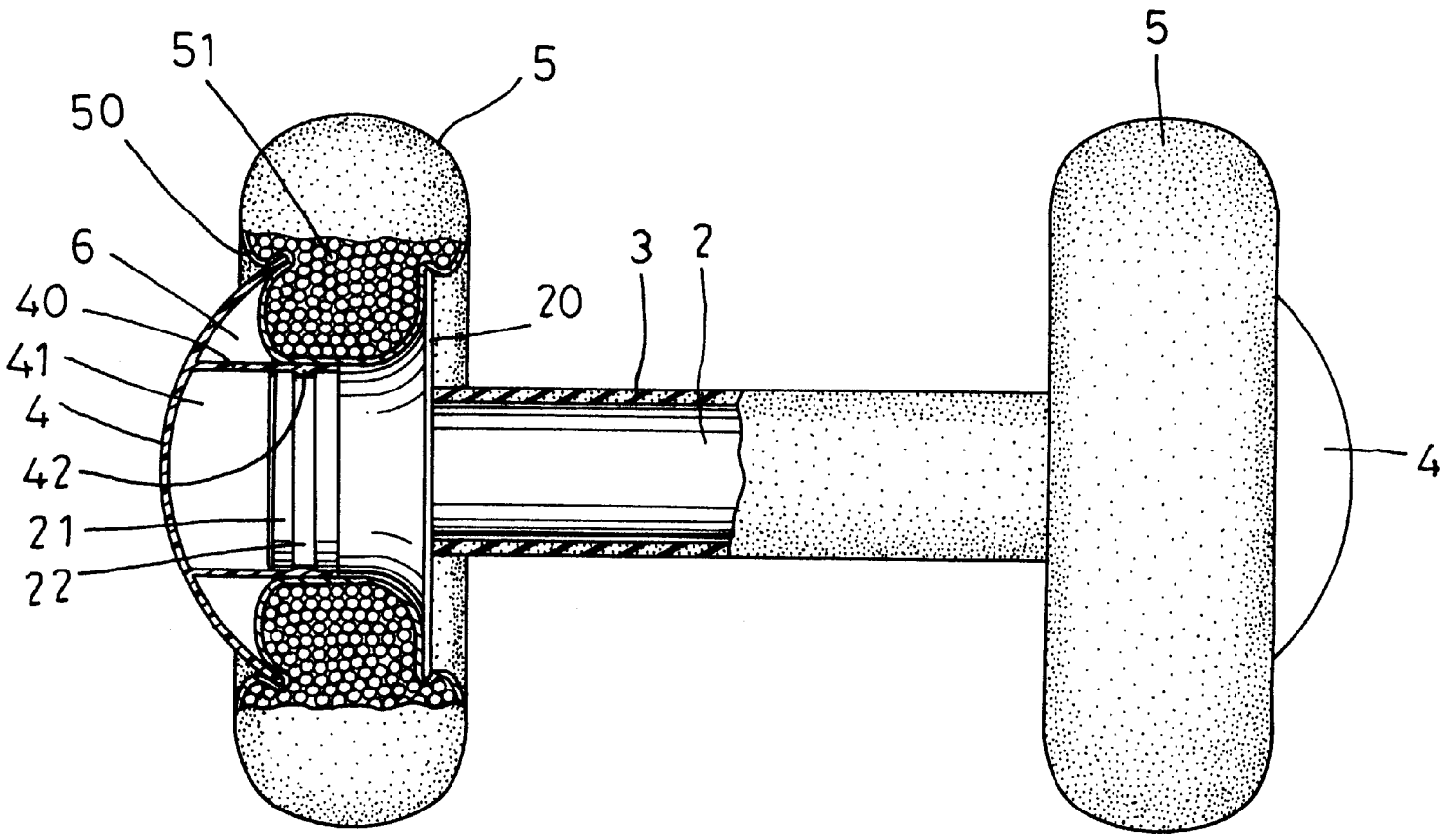
FIG. 3 is a side cross-sectional view of the dumbbell in the present invention; and, FIG. 4 is a perspective view of the dumbbell in the present invention.
Figure 4:
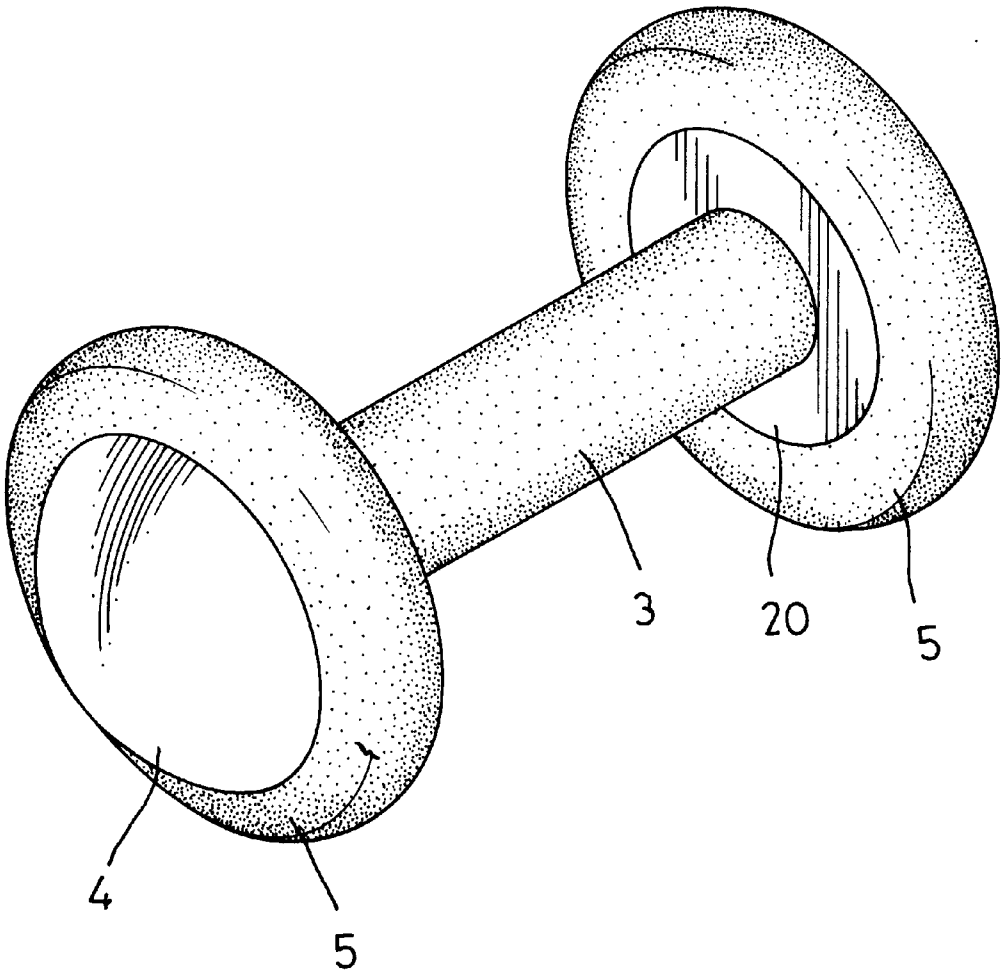

In assembly, as shown in FIGS. 2, 3 and 4, firstly, the soft cushion 3 is wound around the bar 2, and then the two end caps 4 are combined respectively with the circular projections 21, with the circular projections 21 inserting in the center hole 41 of the tubular projection 40, and with the annular projection 42 engaging the annular insert groove 22 of the circular projection 21. Therefore, the end caps 4 are inserted in the two ends of the bar 2 in a stabilized condition. The space between each end cap 4 and the stop disc 20 forms a support space 6 for fitting each weight 5 around there, and a user may select and push each weight 5 from the end cap 4 to the stop disc 20. As the weights 5 have flexibility so that the elastic annular cloth bag 50 may expand elastically and the iron sand 51 may also move with the elastic cloth bag 50, changing the shape of the weight 5 to be pushed to the support space 6, when the weight 5 is pushed and fitted around the support space 6. After the weight 5 is already fitted around the support space 6, it has no expanding force, with the elastic cloth bag 50 shrinking and fitting around the support space 6. Then the shape of the weight may be adjusted a bit and the inner hole of the weight 5 may fit closely around the support space 6 stabilized. Then the weight 5 cannot fall off the bar 2 positioned between the stop disc 30 and the end cap 4. Then the dumbbell is finished in assembly, simple and quick to handle.

In using, if a user wants to replace the weights 5 with new ones of different volumes, only move the weights 5 outward with the elastic cloth bags 50 expanding outward, and with the iron sand 51 moving accordingly so that the weights 5 may change the shape a bit to be taken out of the support space 6. Then new weights 5 may be placed on the bar 2 easily.

In using, even if the user should let the dumbbell fall down carelessly, the weighs 5 may disperse the iron sand 51 owing to the flexibility of the weights 5 and the buffer function among the iron sand, reducing sound of striking the ground surface. In addition, the weights 5 may become flat when they touch on the ground surface, not hurting the body of a person by rolling around. Even if the weights 5 should fall directly on the body of a user or another person around, it may not hurt the user or the person around as they are flexible and the iron sand 51 may disperse its shock, largely safer to use than the known conventional ones.

The dumbbell in the invention has the following advantages, as can be understood from the aforesaid description.

1. The weights are each made of an elastic annular cloth bag wrapping iron sand, having flexibility not producing sound even if the dumbbell should fall down on the ground, and not hurting the ground surface and themselves.

2. The weights might not hurt a user or another person around, even if the dumbbell should fall down or hit the user or another person around, quite safe to use.

3. The weights never fall off the bar, but are secured around the support member and stabilized.

4. It is easy and quick to assemble.

While the preferred embodiment of the invention has been described above, it will be recognized and understood that various modifications may be made therein and the appended claims are intended to cover all such modifications that may fall within the spirit and scope of the invention.

What is claimed is:

1. A dumbbell comprising a bar, a soft cushion laid around said bar, a vertical stop disc formed at two ends of said bar, said vertical stop disc having a circular projection extending outward, said circular projection having an annular groove, said bar having an end cap closing up respectively each of the two ends of said bar, each said end cap having a convex outer side and a tubular projection extending inward from a inner center surface of said convex outer side, said tubular projection having an annular projection formed on an inner surface to engage with said annular groove of said annular projection of said bar, a support space formed between each said end cap and said vertical circular disc for a weight to fit around said support space, said weights respectively made of an elastic annular cloth bag wrapping iron sand of a certain weight therein and having flexibility to change their shape to fit around said support space by force, such that a user may replace said weights with other ones of different weight volume, said weights not producing sound because of the soft flexible bodies of said weights dispersing shock of striking the ground surface when said dumbbell falls down on the ground, said dumbbell not hurting the ground surface, said weights, a user or a person around, and thus quite safe to use.

* * * * *